US008912958B2

(12) United States Patent
Miyakawa

(10) Patent No.: US 8,912,958 B2
(45) Date of Patent: Dec. 16, 2014

(54) RADIO COMMUNICATION DEVICE

(75) Inventor: Tetsu Miyakawa, Yokohama (JP)

(73) Assignee: Kyocera Corporation, Kyoto (JP)

( * ) Notice: Subject to any disclaimer, the term of this patent is extended or adjusted under 35 U.S.C. 154(b) by 767 days.

(21) Appl. No.: 12/934,977

(22) PCT Filed: Mar. 24, 2009

(86) PCT No.: PCT/JP2009/055766
§ 371 (c)(1),
(2), (4) Date: Nov. 9, 2010

(87) PCT Pub. No.: WO2009/119552
PCT Pub. Date: Oct. 1, 2009

(65) Prior Publication Data

US 2011/0050507 A1 Mar. 3, 2011

(30) Foreign Application Priority Data

Mar. 28, 2008 (JP) ..... P2008-087981

(51) Int. Cl.
*H01Q 1/38* (2006.01)
*H01Q 1/22* (2006.01)
*H01Q 1/48* (2006.01)
*H01Q 11/08* (2006.01)

(52) U.S. Cl.
CPC ..... *H01Q 1/2258* (2013.01); *H01Q 1/48* (2013.01); *H01Q 11/083* (2013.01)
USPC ..... 343/700 MS

(58) Field of Classification Search
USPC ..... 343/700 MS
See application file for complete search history.

(56) References Cited

U.S. PATENT DOCUMENTS

| | | | | |
|---|---|---|---|---|
| 6,100,855 | A * | 8/2000 | Vinson et al. | 343/846 |
| 6,348,893 | B1 * | 2/2002 | Herranen et al. | 343/702 |
| 6,476,766 | B1 * | 11/2002 | Cohen | 343/700 MS |
| 2002/0101382 | A1 * | 8/2002 | Konishi et al. | 343/702 |

FOREIGN PATENT DOCUMENTS

| | | |
|---|---|---|
| CN | 1332489 | 1/2002 |
| CN | 2669382 | 1/2005 |
| JP | 57-098010 | 6/1982 |
| JP | 02-271701 | 11/1990 |
| JP | 04-179302 | 6/1992 |
| JP | 08-242117 | 9/1996 |
| JP | 08-316725 | 11/1996 |
| JP | 10-261914 | 9/1998 |

(Continued)

OTHER PUBLICATIONS

JP2010-505655 Office Action mailed Dec. 4, 2012.

(Continued)

*Primary Examiner* — Graham Smith
(74) *Attorney, Agent, or Firm* — Duane Morris LLP

(57) ABSTRACT

A radio communication device according to the present invention which is inserted into an expansion slot of an electronic device, includes: a printed circuit board having a rectangular shape, and provided with a connection terminal on one short side that connects to the expansion slot; an antenna element provided on the printed circuit board extending in a direction orthogonal thereto in the vicinity of an other short side of the printed circuit board, and having a substantially ¼λ electrical length; and a radial line extending on the printed circuit board with a position where the antenna element is arranged as an end point.

5 Claims, 2 Drawing Sheets

(56) References Cited

FOREIGN PATENT DOCUMENTS

| | | |
|---|---|---|
| JP | 2003-133847 | 5/2003 |
| JP | 2003-142915 | 5/2003 |
| JP | 2004-064312 | 2/2004 |
| JP | 2004-120296 | 4/2004 |
| JP | 2005-159725 | 6/2005 |
| JP | 2006-005867 | 1/2006 |
| JP | UM-B3128219 | 12/2006 |

OTHER PUBLICATIONS

CN200980109151.8 First Office Action mailed Nov. 5, 2012.
International Search Report for PCT/JP2009/055766, mailed on Jun. 30, 2009, 2 pages.

* cited by examiner

RADIO COMMUNICATION DEVICE

CROSS-REFERENCE TO RELATED APPLICATIONS

This is a U.S. National Phase Application of International Application No. PCT/JP2009/055766 filed Mar. 24, 2009, which claims priority to Japanese Patent Application No. 2008-087981 filed Mar. 28, 2008, the disclosures of which are incorporated herein by reference in their entirety.

TECHNICAL FIELD

The present invention relates to a radio communication device.

BACKGROUND ART

As a radio communication device, a PC card that has an antenna built-in inside a casing, and that is used inserted into an expansion slot of a personal computer or the like, has been put to practical use. This built-in antenna type PC card has been developed with the object of further miniaturizing PC cards furnished with movable external antennas. This PC card achieves miniaturization by mounting a built-in antenna within a casing instead of providing an external antenna outside of the casing. As technology related to the PC card with built-in antenna, Patent document 1 below discloses a compact antenna (reverse-F antenna), and a PC card with this compact antenna built-in, that can receive a desired vertical polarization component, and can widen the frequency bandwidth of VSWR, even when built-into a PC card or the like of uniform thickness.

The compact antenna is constituted by a substrate and chip parts made of resin that are mounted on the substrate. The substrate includes ground conductors formed on the back of the substrate, a first short-circuit conductor wiring formed on a main surface of the substrate, and a through-hole that connects these. The chip parts include a second short-circuit conductor wiring, a radiating conductor, a short-circuit conductor, and a power supply conductor wiring. The second short-circuit conductor wiring is formed on the underside of the chip parts and faces the first short-circuit conductor wiring on the substrate. The radiating conductor is formed on the upper surface of the chip parts. The short-circuit conductor is formed on the end surface of the chip parts, and connects the second short-circuit conductor wiring and the radiating conductor. The power supply conductor wiring is formed on the side surface of the chip parts and is connected to the radiating conductor.

[Patent Document 1] Japanese Unexamined Patent Application, First Publication No. 2003-133847

DISCLOSURE OF INVENTION

Problem to be Solved by the Invention

In the above-mentioned PC card type radio communication device, a ground pattern that is formed horizontally with respect to a printed circuit board, picks up radiated waves in a horizontal direction, which strengthens the horizontal polarization component of the radio wave. In particular, in a PC card-type radio communication device that uses a built-in antenna, the strength of the vertical polarization component of the radio wave is weaker than in a device that has a movable external antenna. In Patent document 1 above, there is disclosed a PC card with built-in antenna that is able to obtain a desired vertical polarization component. However, even when this PC card is used, the strength of the vertical polarization component is relatively weak compared to a PC card with a movable external antenna.

The PC card type radio communication device mainly transmits and receives vertically polarized radio waves. Therefore by right, the strength of the vertical polarization component of the radio wave needs to be increased. However, with the PC card type radio communication device that uses the abovementioned built-in antenna, the strength of the vertical polarization component tends to be weak due to miniaturization. However, in order to realize stable radio quality as a PC card type radio communication device, the strength of the vertical polarization component also when using the built-in antenna, needs to be made stronger.

The present invention takes into consideration the above situation, and an object thereof is to provide a PC card type radio communication device that uses a built-in antenna and which is capable of increasing the strength of the vertical polarization component of radio waves to a greater extent than heretofore.

Means for Solving the Problem

To achieve the object, a radio communication device according to the present invention which is inserted into an expansion slot of an electronic device, includes: a printed circuit board having a rectangular shape, and provided with a connection terminal on one short side that connects to the expansion slot; an antenna element provided on the printed circuit board extending in a direction orthogonal thereto in the vicinity of an other short side of the printed circuit board, and having a substantially ¼λ electrical length; and a radial line extending on the printed circuit board with a position where the antenna element is arranged as an end point.

In the radio communication device according to the present invention, a plurality of radial lines may be provided in a radial pattern on the printed circuit board with a position where the antenna element is arranged as a center.

In the radio communication device according to the present invention, a length of the radial line from the end point to an other end point may substantially ¼λ electrical length.

In the radio communication device according to the present invention, the radial line may be electrically connected to a ground included in the printed circuit board.

In the radio communication device according to the present invention, the radial line may be provided on a surface on an opposite side to a surface of the printed circuit board on which the antenna element is arranged.

In the radio communication device according to the present invention, the antenna element may be one of a helical antenna and a chip antenna.

Effect of the Invention

A radio communication device according to the present invention which is inserted into an expansion slot of an electronic device, includes: a printed circuit board having a rectangular shape, and provided with a connection terminal on one short side that connects to the expansion slot; an antenna element provided on the printed circuit board extending in a direction orthogonal thereto in the vicinity of an other short side of the printed circuit board, and having a substantially ¼λ electrical length; and a radial line extending on the printed circuit board with a position where the antenna element is arranged as an end point. Therefore, a ground plane antenna is formed on the printed circuit board, and by means of the ground plane antenna, radio waves having an electric field in the same direction as the direction orthogonal to the printed circuit board, that is, radio waves including mainly the vertical polarization component, can be radiated and received. Consequently, according to the present invention, the strength of the vertical polarization component of the radio waves can be made stronger than heretofore. Furthermore, due to the cooperation between the antenna element and the radial line, a situation where the radio wave is terminated in the ground pattern formed horizontally with respect to the printed circuit board can be prevented. Therefore the strength of the vertical polarization component can be increased.

REFERENCE SYMBOLS

A PC card with built-in antenna
1 Printed circuit board
1*a* Ground pattern
1*b* Connector
1*c* Micro-strip line
1*d* Power supply line
1*e* Radial line
1*f* Ground plane
2 Helical antenna
2*a* Dielectric substance
2*b* Conductive line

BEST MODE FOR CARRYING OUT THE INVENTION

Hereunder is a description of an embodiment of the present invention with reference to the drawings. This embodiment conforms to the specifications of the Personal Computer Memory Card International Association (PCMCIA). This embodiment is related to a PC (Personal Computer) card with built-in antenna in which an antenna is built-in inside a casing. The PC card with built-in antenna in the present embodiment is the radio communication device in the present invention.

Figure 1:
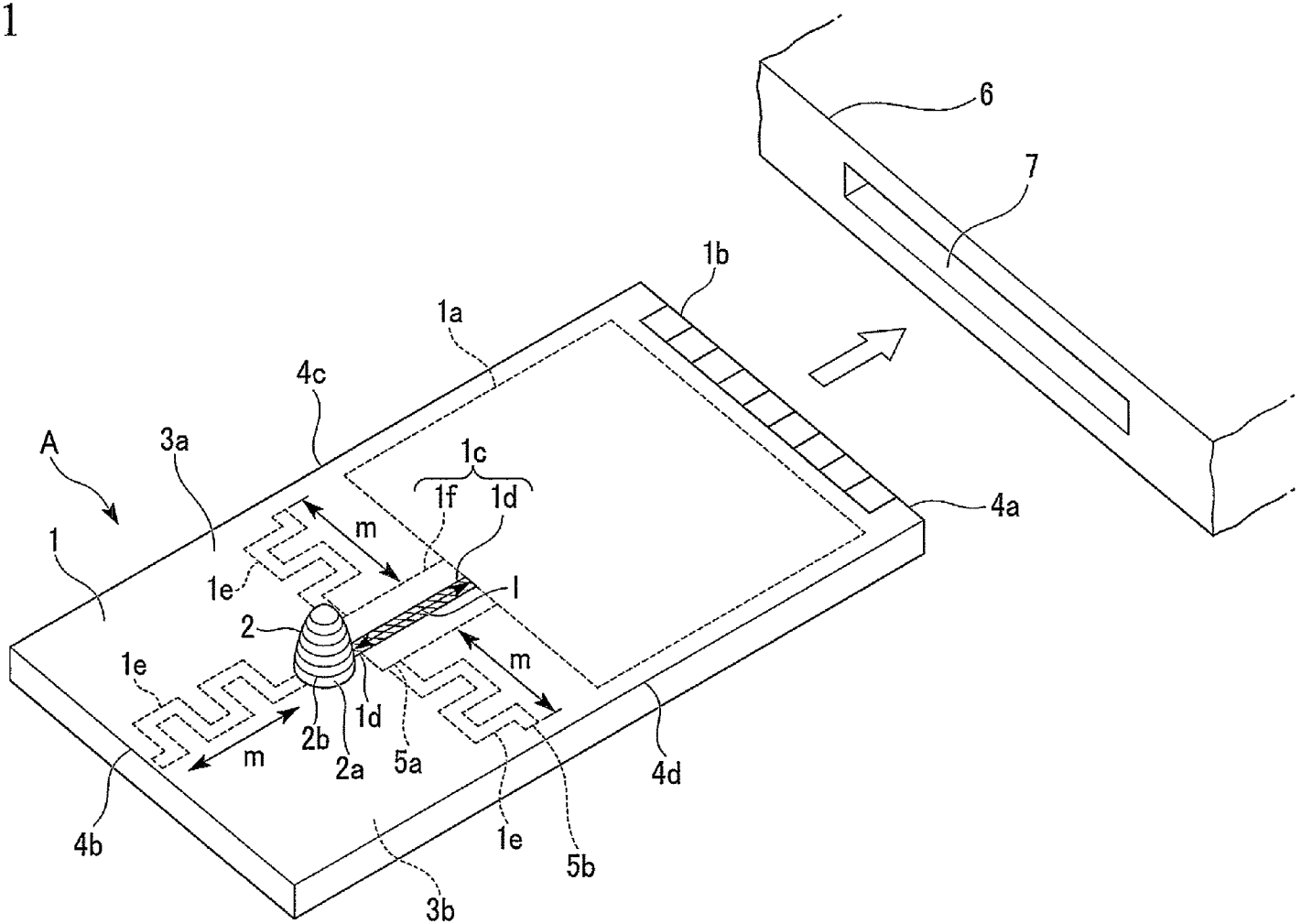
FIG. 1 is a perspective view showing a schematic configuration of the interior of a PC card with built-in antenna according to an embodiment of the present invention, with a casing removed.

FIG. 1 is a perspective view showing a schematic configuration of the interior of a PC card with built-in antenna A according to the present embodiment, with the casing removed. The PC card with built-in antenna A is inserted into an expansion slot of a notebook type personal computer as shown in the figure. The PC card with built-in antenna A, under instructions of the notebook type personal computer, performs wireless communication with an external device using the vertical polarization component of radio waves.

The PC card with built-in antenna A includes a printed circuit board 1, a helical antenna 2, and a casing serving as an exterior part (omitted from the drawing).

The printed circuit board 1 is a rectangular two layer substrate in which a ground pattern 1*a* and a signal pattern are formed sequentially from the back face layer. In the printed circuit board 1, a connector 1*b* is provided on one of the short sides.

This connector 1*b* is connected to a connector inside the expansion slot 7 of the notebook type personal computer 6. In the following description, in the printed circuit board 1, the short side on which the connector 1*b* is provided is called the printed circuit board bottom edge 4*a*, and the short side on the opposite side to the connector 1*b* is called the printed circuit board top edge 4*b*. Furthermore, the side on the right side facing the printed circuit board bottom edge 4*a* is called the printed circuit board right edge 4*c*, and the side on the opposite side to the printed circuit board right edge 4*c* is called the printed circuit board left edge 4*d*. The ground pattern 1*a* in the back face layer of the printed circuit board 1 is formed on the back face 3*b* spanning from near the longitudinal center of the printed circuit board 1 to the vicinity of the connector 1*b*.

The helical antenna 2 captures the reception radio wave, and outputs this to an RF circuit (not shown in the figure) as a received signal. On the other hand, the helical antenna 2 radiates the transmission signal input from the RF circuit into the air as a transmission radio wave. The helical antenna 2 is arranged at a position separated from the center of one edge on the printed circuit board top edge 4*b* side of the ground pattern 1*a*, by just ⅛λ electrical length in the direction of the printed circuit board top side (in FIG. 1, the length of the arrow denoted by reference symbol 1). The helical antenna 2 includes a dielectric substance 2*a*, and a conductive line 2*b*, and is formed by winding the conductive line 2*b* which has a ¼λ electrical length in a coil shape on the dielectric substance 2*a* serving as a core. Here λ is the wavelength of the radio wave used in radio communication.

A power supply line 1*d* is provided on the printed circuit board 1 on the printed circuit board bottom edge 4*a* side of the helical antenna 2. This power supply line 1*d* is constructed from copper foil or the like that constitutes a micro-strip line 1*c*. Power supply to the helical antenna 2 is performed via the power supply line 1*d* of the micro-strip line 1*c*. The micro-strip line 1*c* is configured from a ground plane 1*f* formed on the back face (lower face) 3*b* and a signal line (power supply line 1*d*) formed on the front face (upper face) 3*a*, with a plate material such as a glass epoxy resin or the like having dielectric properties being the base material of the printed circuit board 1 sandwiched therebetween.

On the back face 3*b* of the printed circuit board 1 there is formed three radial lines 1*e* constituted from copper foil or the like, radiating from the position where the helical antenna 2 is provided. These three radial lines 1*e*, with the printed circuit board right edge 4*c* side of the helical antenna 2, the printed circuit board left edge 4*d* side of the helical antenna 2, and the printed circuit board top edge 4*b* side of the helical antenna 2 as an end point 5*a*, respectively extend to another end point 5*b* while meandering towards the printed circuit board right edge 4*c* direction, the printed circuit board left edge 4*d* direction, and the printed circuit board top edge 4*b* direction. Consequently, the radial line 1*e* extended in the printed circuit board right edge 4*c* direction, and the radial line 1*e* extended in the printed circuit board top edge 4*b* direction have a 90 degree angle with respect to each other and are formed on the printed circuit board 1. The radial line 1*e* extended in the printed circuit board top edge 4*b* direction, and the radial line 1*e* extended in the printed circuit board left edge 4*d* have a 90 degree angle with respect to each other and are formed on the printed circuit board 1. The radial line 1*e* extended in the printed circuit board left edge 4*d*, and the radial line 1*e* extended in the printed circuit board right edge 4*c* direction have a 180 degree angle with respect to each other, and are formed on the printed circuit board 1.

These three radial lines 1*e* extend from a position where the helical antenna 2 is provided, and have a length of ¼λ electrical length (in FIG. 1 the length of the arrow denoted by reference symbol m) in their respective directions of the printed circuit board right edge 4*c*, the printed circuit board left edge 4*d*, and the printed circuit board top edge 4*b*. Furthermore, the three radial lines 1*e* are electrically connected to the ground plane 1*f* of the back face 3*b* of the printed circuit board 1 that forms the micro-strip line 1*c*. In the PC card with built-in antenna A, the ground plane antenna is formed by the helical antenna 2 and the three radial lines 1*e*.

Figure 2A:
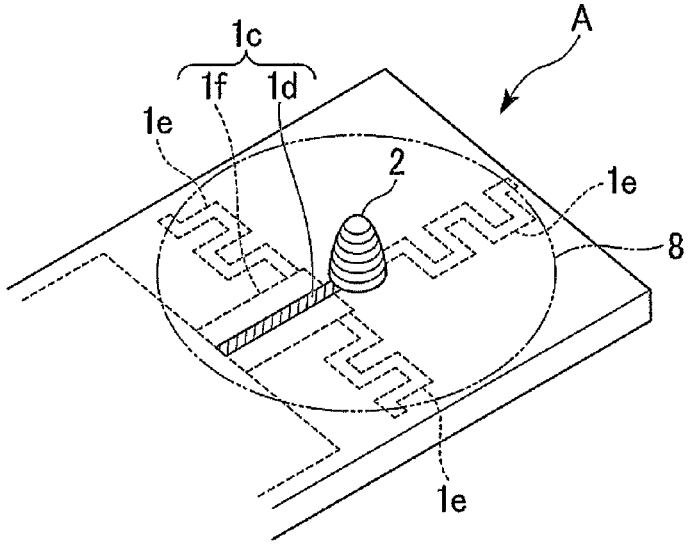
FIG. 2A is a schematic diagram illustrating radiation and reception theory of radio waves in a ground plane antenna constituted by a helical antenna and a radial line, of the PC card with built-in antenna according to the embodiment of the present invention.
Figure 2B:
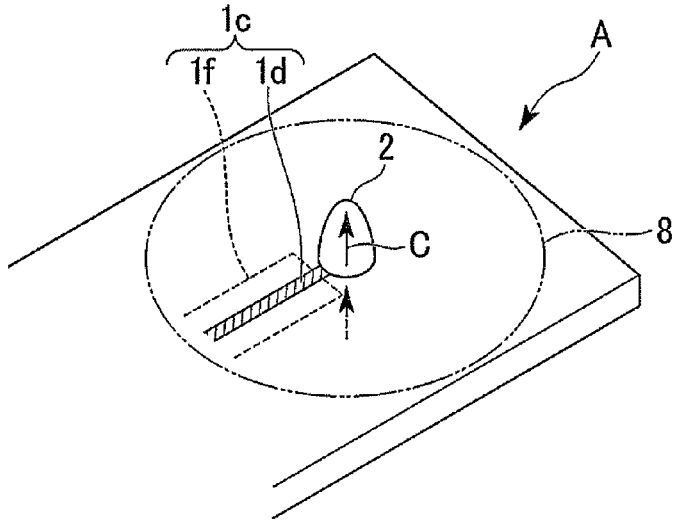
FIG. 2B is a schematic diagram illustrating radiation and reception theory of radio waves in the ground plane antenna constituted by the helical antenna and the radial line, of the PC card with built-in antenna according to the embodiment of the present invention.
Figure 2C:
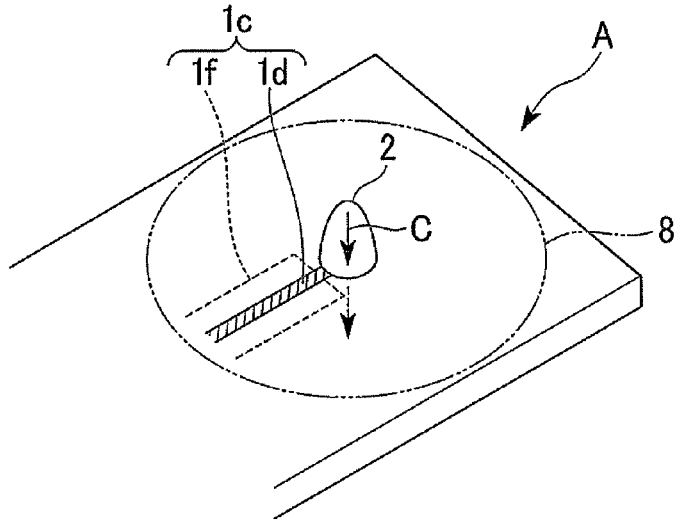
FIG. 2C is a schematic diagram illustrating radiation and reception theory of radio waves in the ground plane antenna constituted by the helical antenna and the radial line, of the PC card with built-in antenna according to the embodiment of the present invention.

Next, is a description of the radiation and reception theory of radio waves in the ground plane antenna configured by the helical antenna 2 and the radial lines 1*e* in the PC card with built-in antenna A of the above construction, with reference to FIG. 2A through FIG. 2C. FIG. 2A to FIG. 2C are schematic diagrams illustrating the radiation and reception theory of radio waves in a ground plane antenna constituted by the helical antenna 2 and the radial lines 1*e*, of the PC card with built-in antenna A according to the present embodiment.

FIG. 2A is a schematic diagram showing a virtual ground 8 that is formed by means of the three radial lines 1*e*. FIG. 2B is a schematic diagram showing the flow of current in the case where a positive high frequency current C flows to the helical antenna 2. FIG. 2C is a schematic diagram showing the flow of current in the case where a negative high frequency current C flows to the helical antenna 2.

As shown in FIG. 2A, in the PC card with built-in antenna A, by arranging the three radial lines 1*e* on the printed circuit board radiating from the position of the helical antenna 2, the virtual ground 8 is formed on the printed circuit board 1 centered on the position of the helical antenna 2. As shown in FIG. 2B, when a positive high frequency current C flows from the power supply line 1*d* to the helical antenna 2, then due to the image effect due to the virtual ground 8, this gives a state equivalent to a state where, with the virtual ground 8 interposed, the current flows from a direction opposite to the direction that the helical antenna 2 protrudes towards the connection point between the power supply line 1*d* and the helical antenna 2.

Furthermore, as shown in FIG. 2C, when a negative high frequency current C flows from the power supply line 1*d* to the helical antenna 2, then due to the image effect, this gives a state equivalent to a state where the current flows from the connection point between the power supply line 1*d* and the helical antenna 2, with the virtual ground 8 interposed, in the direction opposite to the direction that the helical antenna 2 protrudes. As a result, in the PC card with built-in antenna A, this gives a state equivalent to the state where a dipole antenna of ½λ electrical length exists, and the radio wave having an electric field in the same direction as the extension direction of the helical antenna 2, that is, a radiated wave including mainly a vertical polarization component can be generated. Furthermore, the PC card with built-in antenna A gives a state equivalent to where a dipole antenna exists, thereby enabling the vertical polarization component of the radio wave to be efficiently received.

Next is a description of the protection effect of the radio wave due to the three radial lines 1*e*, with respect to the radio wave of the helical antenna 2.

In a conventional PC card with built-in antenna, the ground that is formed horizontally with respect to the printed circuit board, picks up the radio waves of the antenna element, which strengthens the horizontal polarization component of the radio wave. Furthermore, distortion is generated in the radio wave of the antenna element due to the noise current generated from the ground.

In the PC card with built-in antenna A, the radial lines 1*e* arranged on the perimeter of the helical antenna 2 and the ground plane 1*f* of the micro-strip line 1*c* are electrically connected, and due to cooperation between the helical antenna 2 and the radial lines 1*e*, an electric field is formed. As a result, in the PC card with built-in antenna A, a situation where the radio wave of the helical antenna 2 is terminated at the ground pattern 1*a* is prevented. As a result, the influence from the ground pattern 1*a* can be kept to a minimum.

As described above, in the PC card with built-in antenna A, the helical antenna 2 is provided at a position separated by just ⅛λ electrical length from the ground pattern 1*a* of the printed circuit board 1, and the radial lines 1*e* are provided radiating from the position of the helical antenna 2 as a center. As a result, a ground plane antenna is formed on the printed circuit board 1, and a radio wave having an electric field in the same direction as the extension direction of the helical antenna 2, that is to say, a radiated electrical wave including mainly the vertical polarization component can be generated.

Furthermore, the radial lines 1*e* arranged at the periphery of the helical antenna 2, and the ground plane 1*f* of the micro-strip line 1*c* are electrically connected, and an electric field is formed due to the cooperation between the helical antenna 2 and the radial line 1*e*. Therefore the situation where the radio wave of the helical antenna 2 is terminated at the ground pattern 1*a* is prevented. As a result, since the vertical polarization component of the radio wave of the helical antenna 2 is protected, the strength of the horizontal polarization component of the radio wave can be weakened, that is to say, the strength of the vertical polarization component can be strengthened. Furthermore, the radial lines 1*e* are provided on the back face 3*b* of the printed circuit board 1 which is the face on the opposite side to the front face on which the helical antenna 2 is provided. Therefore, between the helical antenna 2 and the radial lines 1*e*, the dielectric substance of glass epoxy resin or the like which is the base material of the printed circuit board 1 is sandwiched. As a result, the permittivity is increased, so that the helical antenna 2 can be miniaturized, that is, it is possible to make the PC card with built-in antenna even thinner.

In the above, an embodiment of the present invention has been described. However, the present invention is not limited to this embodiment, and for example the following modifications can be considered.

(1) In the embodiment, for the antenna element, the helical antenna 2 is provided on the printed circuit board 1; however, the present invention is not limited to this.

For example, instead of the helical antenna 2, a chip antenna may be mounted on the printed circuit board 1 as an antenna element.

(2) In the embodiment, three radial lines 1*e* are provided centered on the position of the helical antenna 2; however, the present invention is not limited to this.

For example, rather than three, two or one are possible. Furthermore, four or more radial lines may be provided. Since the performance is improved as the virtual ground 8 becomes close to a circle of radius ¼λ electrical length, if the number of radial lines 1*e* is increased, the performance as a ground plane antenna is improved with the increase.

(3) In the embodiment, the radial lines 1*e* are provided on the back face 3*b* of the printed circuit board 1 which is the surface on the opposite side to the front face where the helical antenna 2 is provided; however, the present invention is not limited to this.

For example, the radial lines 1*e* may be provided on the front face 3*a* of the printed circuit board 1 which is the same as the surface where the helical antenna 2 is provided.

(4) In the embodiment, the end points 5*a* of the two radial lines 1*e* which have the end points on the printed circuit board right edge 4*c* of the helical antenna 2 and the printed circuit board left edge 4*d* of the helical antenna 2, are formed on the printed circuit board 1 so as to connect to the ground plane 1*f* of the micro-strip line 1*c*; however, the present invention is not limited to this.

For example, in the case where the distance between the helical antenna 2 and the ground pattern 1*a* is shorter than ⅛λ electrical length, that is, the helical antenna 2 and the ground pattern 1*a* are adjacent, the two radial lines 1*e* may be extended towards the helical antenna 2 with the central vicinity of one edge on the printed circuit board top edge 4*b* side in the ground pattern 1*a* as the end point, and bent at right angles before the helical antenna 2, and extended while meandering towards the printed circuit board right edge 4*c* or towards the printed circuit board left edge 4*d*.

INDUSTRIAL APPLICABILITY

The present invention can be applied to a radio communication device. According to a radio communication device, the strength of the vertical polarization component of the radio wave can be made stronger than heretofore.

The invention claimed is:

1. A radio communication device which is inserted into an expansion slot of an electronic device, comprising:

a printed circuit board having a rectangular shape with opposed short sides and opposed long sides, and provided with a connection terminal on one short side that connects to the expansion slot;

an antenna element provided on the printed circuit board extending in a direction orthogonal thereto in the vicinity of the other short side of the printed circuit board, and having a substantially λ/4 electrical length, the antenna element being located at a position separated from a ground pattern of the printed circuit board by a distance substantially equal to λ/8 in electrical length; and at least three radial lines extending outwardly from the antenna element on the printed circuit board, the three radial lines having a similar length to each other, wherein a first of the radial lines extends from the antenna element toward the other short side, a second of the radial lines extends from the antenna element toward one of the long sides, and a third of the radial lines extends from the antenna element toward the other of the long sides, wherein the second and third radial lines are orthogonal to the first radial line.

2. The radio communication device according to claim 1, wherein a length of each of the three radial lines from one end point to another end point is substantially λ/4 in electrical length.

3. The radio communication device according to claim 1, wherein each of the three radial lines is electrically connected to a ground included in the printed circuit board.

4. The radio communication device according to claim 1, wherein each of the three radial lines is provided on a surface on an opposite side to a surface of the printed circuit board on which the antenna element is arranged.

5. The radio communication device according to claim 1, wherein the antenna element is one of a helical antenna and a chip antenna.

* * * * *